US007222612B2

(12) United States Patent
Hagler et al.

(10) Patent No.: US 7,222,612 B2
(45) Date of Patent: May 29, 2007

(54) LOW-RESISTANCE HYDROCARBON ADSORBER CARTRIDGE FOR AN AIR INTAKE OF AN INTERNAL COMBUSTION ENGINE

(75) Inventors: Dean R. Hagler, Davison, MI (US); James P. Vargo, Swartz Creek, MI (US)

(73) Assignee: Delphi Technologies, Inc., Troy, MI (US)

( * ) Notice: Subject to any disclaimer, the term of this patent is extended or adjusted under 35 U.S.C. 154(b) by 148 days.

(21) Appl. No.: 11/044,504

(22) Filed: Jan. 27, 2005

(65) Prior Publication Data

US 2006/0162704 A1 Jul. 27, 2006

(51) Int. Cl.
*F02M 37/20* (2006.01)

(52) U.S. Cl. ..... 123/516; 123/518

(58) Field of Classification Search ..... 123/516, 123/518, 519, 520, 198 D, 198 DB
See application file for complete search history.

(56) References Cited

U.S. PATENT DOCUMENTS 3,477,210 A * 11/1969 Hervert ..... 96/144
3,541,765 A * 11/1970 Adler et al. ..... 96/138
3,572,013 A * 3/1971 Hansen ..... 96/138
3,678,663 A * 7/1972 Hansen ..... 96/141
4,261,717 A * 4/1981 Belore et al. ..... 96/112
4,276,864 A * 7/1981 Waschkuttis ..... 123/544
6,432,179 B1 * 8/2002 Lobovsky et al. ..... 96/296
6,440,200 B1 * 8/2002 Sakakibara et al. ..... 96/134
6,464,761 B1 * 10/2002 Bugli ..... 96/135
6,505,610 B2 * 1/2003 Everingham et al. ..... 123/516
6,637,415 B2 * 10/2003 Yoshioka et al. ..... 123/518
6,692,551 B2 * 2/2004 Wernholm et al. ..... 95/146
6,692,555 B2 * 2/2004 Oda et al. ..... 96/134
6,698,403 B2 * 3/2004 Honda et al. ..... 123/520
6,699,310 B2 * 3/2004 Oda et al. ..... 96/132
6,736,871 B1 * 5/2004 Green et al. ..... 55/385.3
6,758,885 B2 * 7/2004 Leffel et al. ..... 96/134
6,786,199 B2 * 9/2004 Oda et al. ..... 123/399
6,835,234 B2 * 12/2004 Leffel et al. ..... 96/108
6,835,237 B2 * 12/2004 Ishida ..... 96/135
6,959,696 B2 * 11/2005 Shears et al. ..... 123/516
6,976,477 B2 * 12/2005 Gimby et al. ..... 123/519
7,028,673 B2 * 4/2006 Itou et al. ..... 123/516
2004/0182240 A1 9/2004 Bause et al.
2004/0226440 A1 11/2004 Foong et al.
2005/0178368 A1 * 8/2005 Donahue et al. ..... 123/520
2005/0188962 A1 * 9/2005 Oda et al. ..... 123/519
2005/0235967 A1 * 10/2005 Itou et al. ..... 123/518
2006/0096458 A1 * 5/2006 Abdolhosseini et al. ..... 96/134
2006/0150811 A1 * 7/2006 Callahan et al. ..... 95/146
2006/0185651 A1 * 8/2006 Hagler ..... 123/518

* cited by examiner

*Primary Examiner*—Thomas Moulis
(74) *Attorney, Agent, or Firm*—Paul L. Marshall

(57) ABSTRACT

A low-resistance hydrocarbon-adsorptive cartridge for an air intake of an internal combustion engine comprising a structure for being mounted into a portion of an engine air intake system. The structure is adapted to orient and retain one or more thin sheets of activated carbon sheeting in the intake system. Preferably, a plurality of sheets is oriented such that the leading edge of each sheet is presented to the engine intake air stream, thereby minimizing reduction in total cross-sectional area of the intake system. Preferably, the one or more sheets are spaced apart by a distance that is small relative to the extent of the elements in the direction of engine air flow such that a high probability is created that hydrocarbons migrating out of a shut down engine's intake manifold will encounter a surface of at least one of the adsorptive sheets and thus be adsorbed.

25 Claims, 6 Drawing Sheets

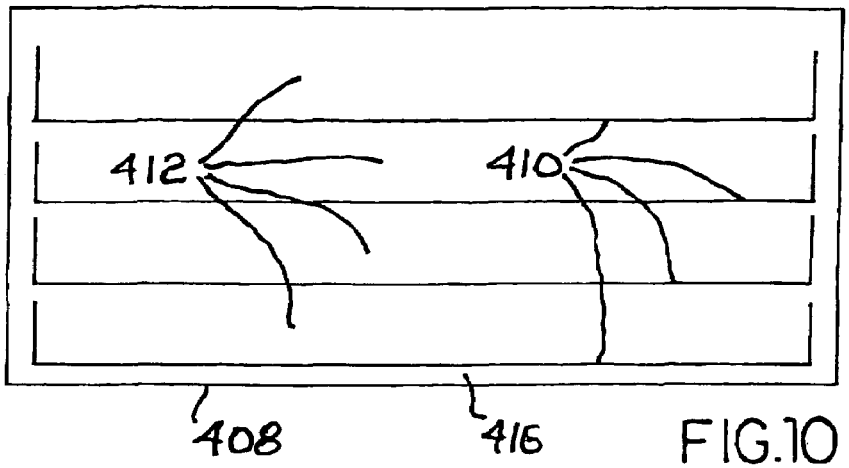
FIG.10
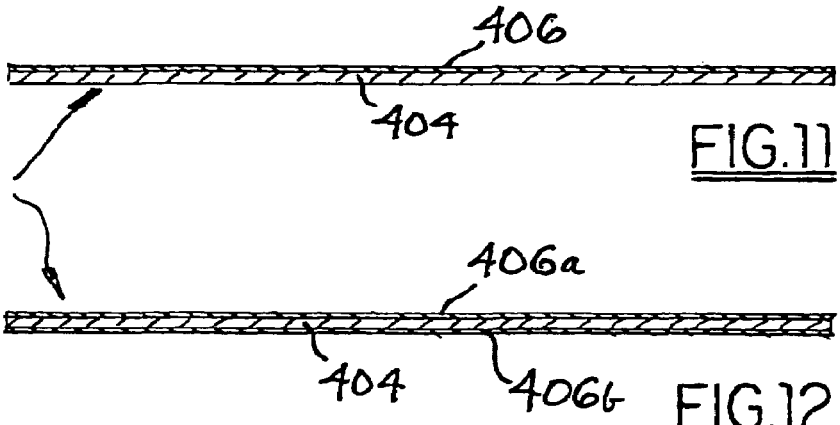
FIG.11
FIG.12
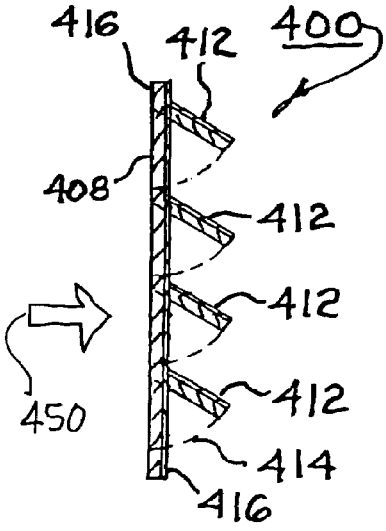
FIG.13

LOW-RESISTANCE HYDROCARBON ADSORBER CARTRIDGE FOR AN AIR INTAKE OF AN INTERNAL COMBUSTION ENGINE

TECHNICAL FIELD

The present invention relates to internal combustion engines; more particularly, to devices for controlling hydrocarbon emissions from internal combustion engines; and most particularly, to a hydrocarbon adsorber cartridge, having low resistance to air flow, for preventing hydrocarbon leakage from the intake manifold of an internal combustion engine after engine shutdown.

BACKGROUND OF THE INVENTION

Gasoline-fueled motor vehicles have many sites from which hydrocarbons (HC) may evaporate into the environment, thereby contributing to the formation of smog. HC in the atmosphere is a major contributor to smog formation. One such known site is the intake manifold of an engine. As HC emission regulations are tightened, a means is needed to prevent HC vapor from escaping from the intake manifold after engine shutdown. Known approaches have included, among others, closing off the intake and idle air with the throttle valve when the engine is shut off; adding a rigid monolith structure formed of activated carbon into the intake air flow path of the air cleaner (see U.S. Pat. No. 6,692,551 B2); and lining the intake manifold, other air ducts, and/or the air cleaner with adsorptive carbon sheeting.

Employing an engine's electronic throttle control to close the intake at shut down may impair the desirable option of a so-called "limp-home" mode in which a vehicle may be driven in the event of a partial failure of the engine electronics control system. Systems with mechanical throttles not employing electronic throttle controls typically close the throttle at shut down leaving a separate "idle air" passage open. In these systems, achieving a completely sealed manifold is difficult and expensive.

Carbon sheeting applied to inner surfaces of the manifold and air ducts is only partially successful because much HC laden air can escape the manifold without being brought into proximity with an adsorptive surface. Relatively large areas of carbon sheeting are required to ensure that an adequate quantity of HC comes into contact with the adsorber.

An adsorptive rigid monolith formed from activated carbon is unsatisfactory as it is expensive to fabricate, brittle and therefore vulnerable to breakage during assembly and use, and inherently restricts the volume of intake air. A known carbon monolith has an open area of only about 80%. The last shortcoming is especially undesirable as both engine performance and fuel efficiency can be adversely affected by undue air flow restriction.

What is needed in the art is a means for providing hydrocarbon adsorption during engine shutdown at the main air entrance to an engine while minimizing intake air restriction during engine operation.

It is a principal object of the present invention to reduce hydrocarbon emissions from a shut down internal combustion engine.

It is a further object of the invention to minimize the restriction of combustion air inflow into the engine caused by a hydrocarbon-adsorptive means.

SUMMARY OF THE INVENTION

Briefly described, a low-resistance hydrocarbon-adsorptive cartridge in accordance with the invention comprises a structure for mounting into a portion of an engine air intake system. The structure is adapted to orient and retain one or more thin sheets of activated carbon sheeting in the intake system. Preferably, a plurality of such sheets is oriented such that the cross-sectional area of each sheet is presented to the engine intake air stream, thereby minimizing reduction in total open area of the intake system. Preferably, the one or more sheets are spaced apart by a distance that is small relative to the extent of the sheets in the direction of engine air flow such that a high probability is created that hydrocarbons migrating out of a shut down engine's intake manifold will encounter a surface of at least one of the adsorptive sheets and thus be adsorbed.

BRIEF DESCRIPTION OF THE DRAWINGS

The present invention will now be described, by way of example, with reference to the accompanying drawings, in which:

FIG. 10 is a front elevational view of a fourth embodiment of a cartidge in accordance with the present invention having a plurality of flaps formed therein;

FIG. 11 is a cross-sectional view of the cartridge shown in FIG. 10 showing a layer containing activated carbon that is coated or bonded to a support;

FIG. 12 is a cross-sectional view of the cartridge which is similar to the cartridge shown in FIG. 11, but includes a layer containing activated carbon coated on both sides of the support; and FIG. 13 is a cross-sectional view of the cartridge shown in FIG. 10 showing the plurality of flaps folded to a predetermined angle.

DESCRIPTION OF THE PREFERRED EMBODIMENTS

Figure 1:
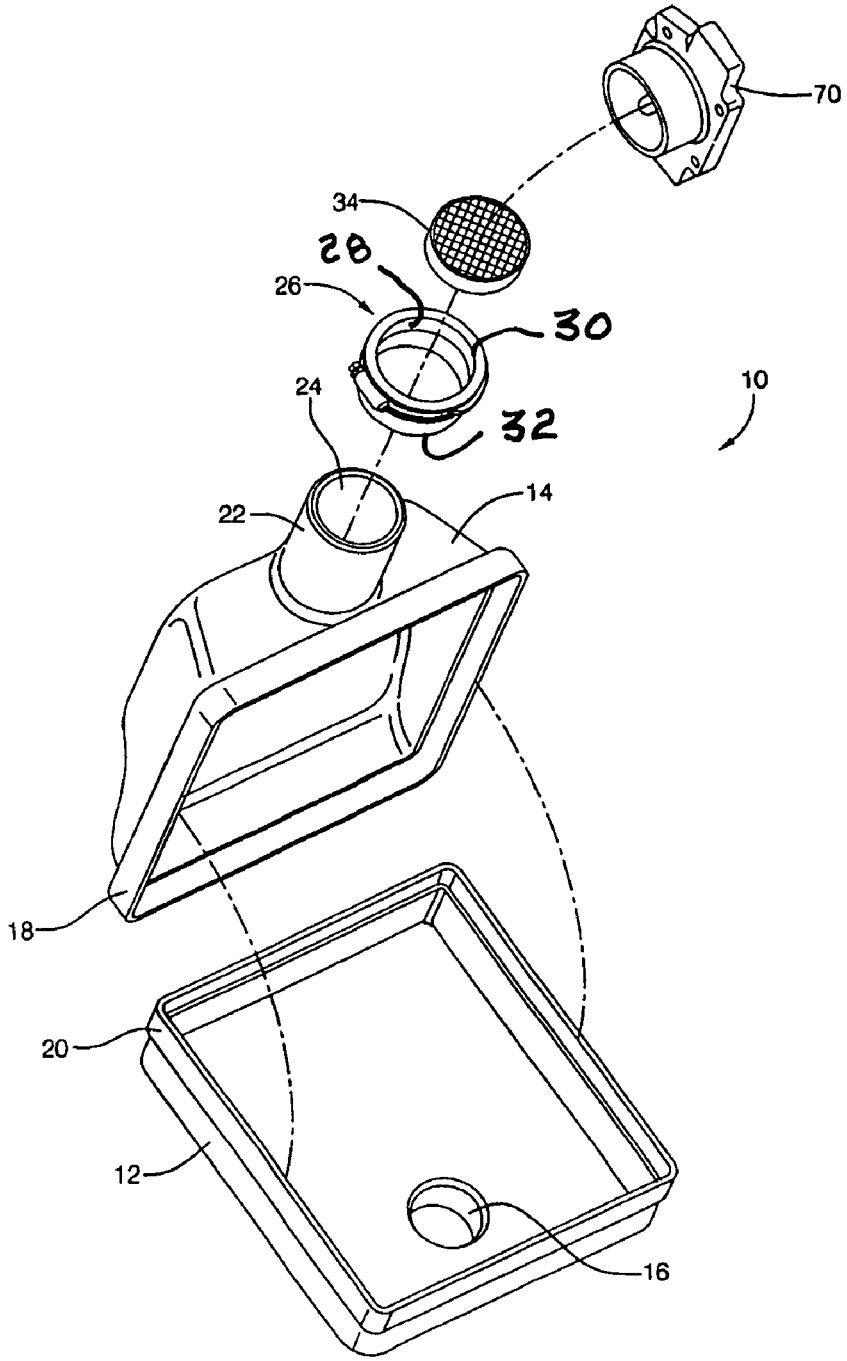
FIG. 1 (PRIOR ART)
FIG. 1 is an exploded isometric view of a prior art rigid monolithic hydrocarbon adsorber installed in an air intake for an internal combustion engine.

Referring now to FIG. 1, there is shown an exploded perspective view of a prior art engine intake air cleaner assembly 10 substantially as disclosed in U.S. Pat. No. 6,692,551 B2, the relevant disclosure of which is incorporated herein by reference. Air cleaner assembly 10 generally comprises a lower case 12 and an upper case 14 that houses one or more filter elements (not shown) for removing particulate matter from an air stream during operation of the internal combustion engine. Conduit 22 extends from upper case 14 to provide inlet-opening 24. Preferably, conduit 22 is cylindrically shaped having an annular wall structure. During operation, inlet opening 24 permits entry of air into air cleaner assembly 10 and thence to the engine combustion chamber or chambers.

A retainer 26, preferably made from a resilient material, is disposed onto conduit 22 of upper case 14 and has a first open end 30 and a second open end 32.

An adsorber member 34, also referred to as a flow regulator, is press fit into the opening defined by the first open end 30. The conformity of shape of first open end 30 is preferably such as to produce an airtight seal between adsorber member 34 and wall 28 defining first open end 30. As such, adsorber member 34 can generally be any shape that conforms to the shape of the opening defined by the first open end 30. In this manner, all gases flowing into the air cleaner assembly 10 must flow through the adsorber member 34. Likewise, any gases contained within the air cleaner assembly 10 such as, for example, those fuel gases that may accumulate in the air cleaner assembly 10 or migrate from the intake manifold after engine shutoff, must pass through the adsorber member 34 in order to enter the atmosphere.

Prior art adsorber member 34 may comprise a substrate coated with pollutant treating material. The substrate can include any material designed for use in a spark ignition or diesel engine environment and which is capable of operating at elevated temperatures dependent upon the device's location and the type of system, which is capable of withstanding exposure to hydrocarbons, nitrogen oxides, carbon monoxide, particulate matter (e.g., soot and the like), carbon dioxide, and/or sulfur, and which has sufficient surface area and structural integrity to support a pollutant treating material, and, where desired, a catalyst. Some possible support materials include cordierite, silicon carbide, metal, metal oxides (e.g., alumina, and the like), glasses, and the like, and mixtures comprising at least one of the foregoing materials. Some ceramic materials include "Honey Ceram", commercially available from NGK-Locke, Inc, Southfield, Mich., and "Celcor", commercially available from Corning, Inc., Corning, N.Y. These materials are preferably in the form of monoliths (e.g., a honeycomb structure, and the like). Preferred monolith supports are carriers of the type having a plurality of fine, parallel gas flow passages extending therethrough from an inlet face to an outlet face of the carrier so that the passages are open to air flow entering and passing through the monolith.

Although the substrate can have any size or geometry, the prior art size and geometry are preferably chosen to optimize surface area in the given design parameters. Preferably, the prior art substrate has a honeycomb geometry, with the combs' through-channels having any multi-sided or rounded shape, with substantially square, triangular, pentagonal, hexagonal, heptagonal, or octagonal or similar geometries preferred due to ease of manufacturing and increased surface area. Also, although each comb forming the honeycomb may be of a different size, the prior art substrate preferably comprises a honeycomb structure wherein all combs are of about equal size. The substrate may comprise about 60 to about 600 or more fluid passageways (cells) per square inch of cross section. The thickness of the substrate may be about ⅛ inch to about 12 inches with about 0.5 to about 3 inches preferred. Preferably the passages are essentially straight from their inlet to their outlet and are defined by walls in which the pollutant treating material may be coated as a washcoat so that the gases flowing through the passages contact the pollutant treating material.

The pollutant treating material can be capable of adsorbing pollutants contained in the air surrounding the substrate. Although the types of pollutants may vary widely depending on the environmental conditions to which the adsorber member 34 is exposed, contemplated pollutants include, but are not limited to, saturated and unsaturated hydrocarbons, certain carbon oxides (e.g., carbon monoxide), nitrates, sulfides, ozone, and the like, and combinations comprising at least one of the foregoing. Such pollutants may typically comprise 0 to 400 parts per billion (ppb) ozone, 1 to 20 parts per million carbon monoxide, 2 to 3000 ppb unsaturated hydrocarbons such as C.sub.2 to C.sub.20 olefins and partially oxygenated hydrocarbons such as alcohols, aldehydes, esters, ketones, and the like. In a preferred embodiment, the pollutant treating material selectively adsorbs unsaturated hydrocarbons such as those unsaturated hydrocarbons utilized in fuels and byproducts caused by combustion.

The pollutant treating material may include adsorbers, such as silicate materials, activated carbon, activated carbons, sulfides, and the like, and combinations comprising at least one of the foregoing.

As noted above, a honeycomb monolith structure preferred in accordance with the prior art, although an effective adsorber of hydrocarbons and other environmental pollutants, creates a large and undesirable pressure drop and flow restriction in the intake air flow path due to a large cross-sectional area of the structure and small-diameter air passages. What is needed is a cartridge for replacing a honeycomb monolith structure which has a large adsorptive surface area to maintain high adsorption but a low cross-sectional area to reduce intake air flow restriction and large-diameter flow passages to reduce viscous drag flow losses.

Figure 2:
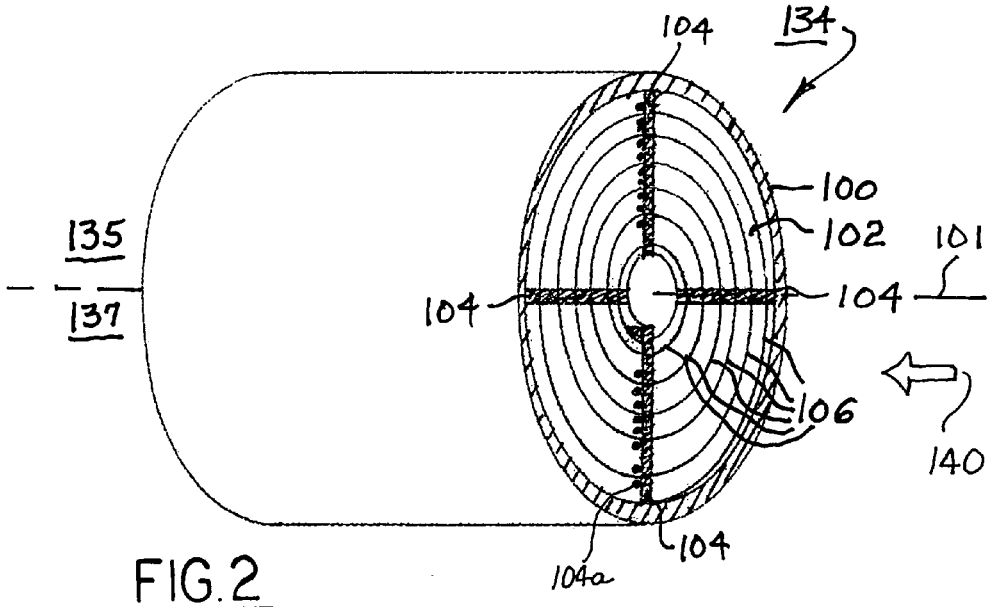
FIG. 2 is an isometric view of a first embodiment in accordance with the invention of a cartridge for use in adsorbing hydrocarbons in an engine air intake.

Referring to FIG. 2, a first embodiment 134 of a cartridge in accordance with the invention is suitable for use anywhere in an intake system 135 of an internal combustion engine 137 and preferably has the adsorption capabilities of prior art adsorber 34 as described above. Preferably, the embodiments shown herein can replace or substitute directly for prior art monolithic adsorber 34.

Figure 2A:
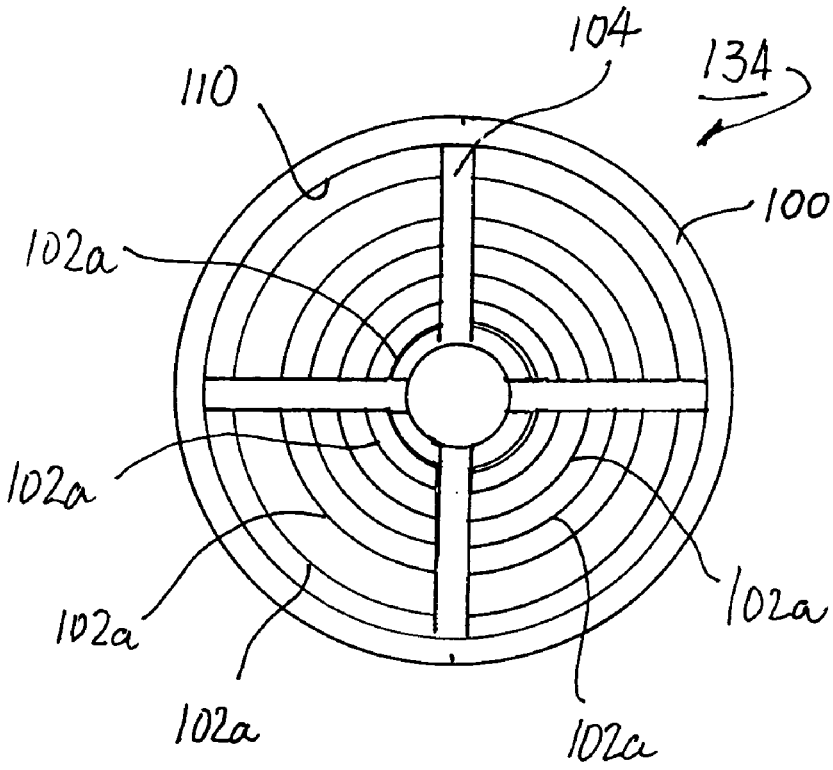
FIG. 2*a* is a front elevational view of a variation of the first embodiment shown in FIG. 2.

First embodiment 134 comprises a structural housing 100 having an axis 101 and having a size and shape specifically selected to fit into a predetermined portion of the air intake ducting of an internal combustion engine, for example, cylindrical. A continuous strip 102 of a thin, flexible, activated charcoal sheet material is spirally disposed within opening 110 of housing 100 and may be bonded as by adhesive or insert molding to a plurality of radial retainers 104 to control and maintain spacing between the convolutions of the spiral. Retainers 104 may optionally include fingers 104*a* for holding adjacent strips of material in place. The width of strip 102 (which is the length of the adsorption path), the number of convolutions, and the spacing of the convolutions may be varied to meet specific application requirements. Of course, the convolutions alternatively may be formed by using a plurality of individual concentric cylindrical sheet elements 102*a* (FIG. 2*a*), but the spiral configuration is currently preferred for manufacturing simplicity.

A currently preferred material for strip 102 is an activated carbon paper available from MeadWestvaco Specialty Papers, Stamford, Conn., USA. This material contains up to 50% by weight of activated carbon and avoids the problem of carbon dusting because the carbon is added to the papermaking slurry prior to paper formation, resulting in a sheet with minimum shedding.

Cartridge 100 presents only the thin leading edge 106 of strip 102 to air 140 flowing through the cartridge and thus provides a very large open area and very low air restriction in comparison to the preferred honeycomb monolith of prior art adsorber 34 which has relatively large wall cross-sections with respect to the open area.

Figure 3:
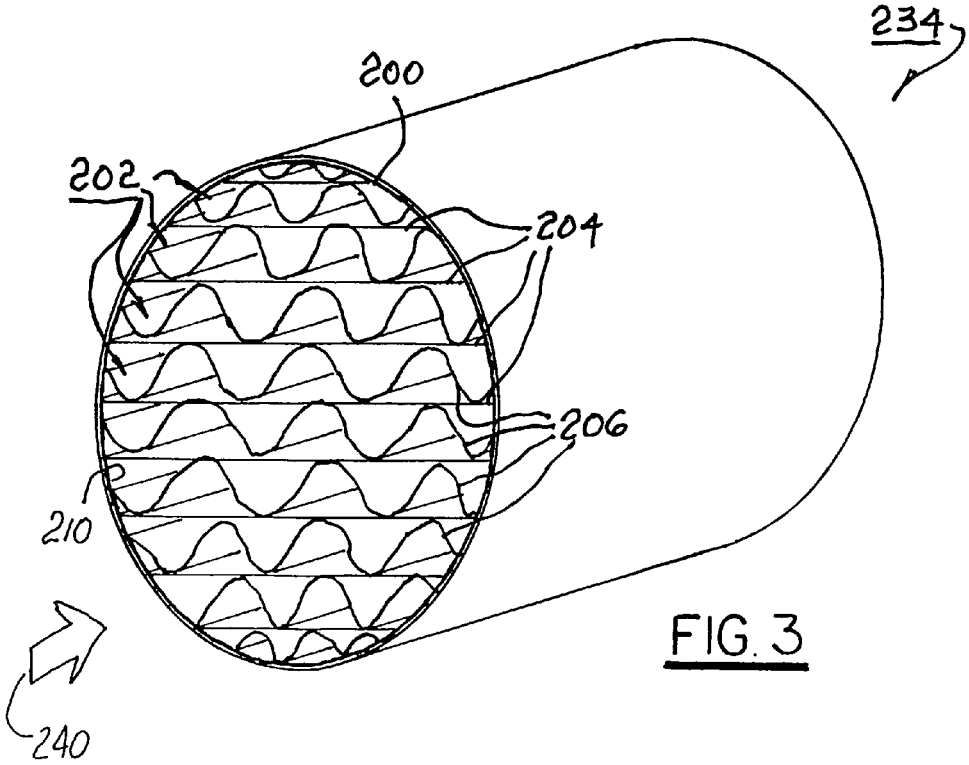
FIG. 3 is an isometric view of a second embodiment of a cartridge.

Referring to FIG. 3, a second embodiment 234 of a cartridge in accordance with the invention is similar to first embodiment 134. However, the adsorptive element is formed as a plurality of corrugated sheets 202 installed longitudinally into opening 210 of housing 200 and preferably separated by spacers 204. Preferably, sheets 202 are formed of the same carbon paper material as strip 102. As in first embodiment 134, cartridge 200 presents only the thin leading edges 206 of strips 202 to air 240 flowing through the cartridge and thus provides a very large open area and very low air restriction. Further, as in first embodiment 134, the adsorptive element is curved or folded in a direction transverse to air flow through the cartridge and thus has great rigidity and dimensional stability.

Figure 4:
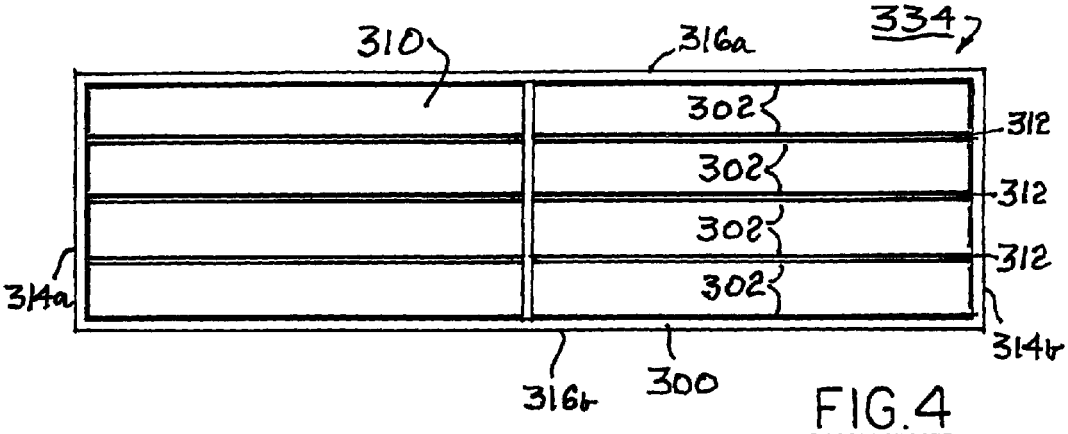
FIG. 4 is a front elevational view of a third embodiment of a cartridge.
Figure 5:
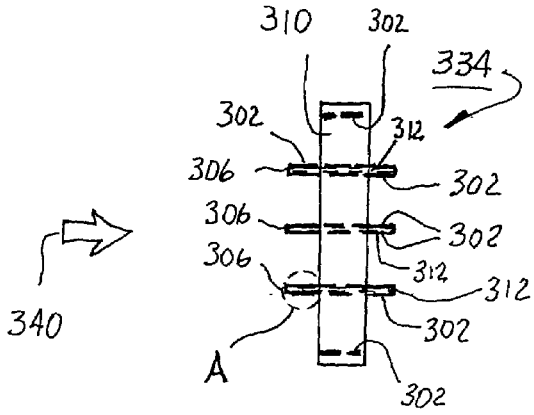
FIG. 5 is a side elevational view of the cartridge shown in FIG. 4.

Referring to FIGS. 4 and 5, a third embodiment 334 includes a rectangular housing 300 for use with a rectangular air duct. Individual strips 302 of carbon paper material extend across an opening 310 of housing 300, presenting strip edges 306 to air 340 flowing through the cartridge. Because strips 302 are substantially planar and thus lack the rigidity imparted by bending in embodiments 134,234, unsupported strips 302 can flutter from the air flow and therefore generally require support in the form of slats 312 extending from sides 314*a*,314*b* of housing 300. Preferably, a strip 302 is disposed on each side of each slat 312, as well as on the inner surfaces of sides 314*a*,314*b*, and sides 316*a*,316*b*. Strips 302 may be secured preferably by lamination with adhesive in known fashion. Of course, the number of slats 312 and the dimensions of housing 300 may be varied to meet specific application requirements.

Figure 7:
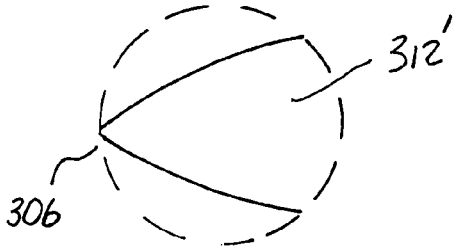
FIGS. 7–9 are elevational views of various shaped slates in a view shown as circle A in FIG. 5.
Figure 8:
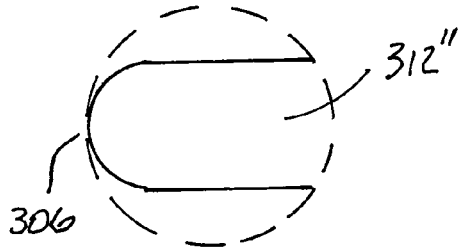
Figure 9:
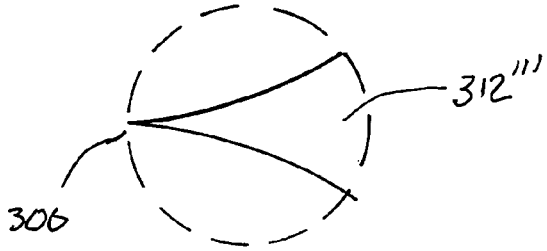
Figure 6:
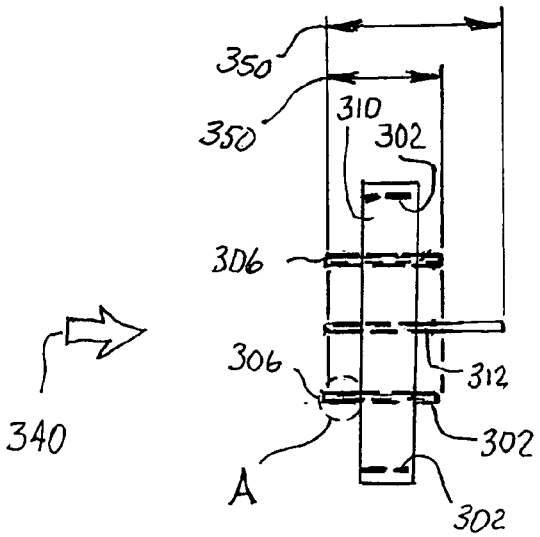
FIG. 6 is a side elevational view of an alternate embodiment of the cartridge shown in FIG. 5.

Further, the cross-sectional shape of slats 312 may be varied to create the intended effect and surface area of strips 302. For example, slats 312 may be planar, as shown in FIGS 4 and 5, or strip edcaes 306 may be V-shaped (312'-FIG. 7), bull-nosed (312"- FIG. 8), or curved (312'"-FIG. 9) to provided a predetermined pressure drop, flow direction, and carbon surface area for an intended application. Slats 312 may also be varied in length 350 (FIG. 6) to further provide a desired pressure drop, flow direction and absorptive area.

Referring to FIGS. 10–13, a fourth embodiment 400 of a hydrocarbon-adsorptive cartridge in accordance with the invention is formed by die-cutting and folding from a suitable sheet 402 of material comprising an inert support 404 and a layer 406 containing activated carbon. Preferably, support 404 is formed of an inexpensive polymeric material, for example, polypropylene, that is capable of taking a heat set after final forming of the cartridge shape. Preferably, layer 406 is substantially equivalent or identical to carbon paper composition 102 and may be coated or bonded to support 404. If desired, layer 406 may be coated to support 404 on both sides (406*a*, 406*b*) to increase further the adsorptive surface area of cartridge 400.

In an exemplary method of forming cartridge 400, a suitably-sized portion 408 of material 402 is die-cut in a predetermined pattern 410 to form a plurality of flaps 412 which are then folded (FIG. 13) to a predetermined angle 414 from portion 408 and then secured at angle 414 as by heat treating. Angle 414 may be an angle between 0 degrees and 90 degrees, as may be desired for optimal engine and adsorptive performance. Further, pattern 410 in the cutting die may be varied to provide any desired number and shape of flaps 412. The border 416 surrounding flaps 412 defines a housing by which the cartridge may be attached or mounted.

As shown in FIG. 13, the orientation of flaps 412 is selected to offer lesser resistance to the flow of engine induction air 450 when the engine is running. Optionally, the thickness and resilience of polymeric sheet 402 is selected to allow flaps 412 to flexibly open from a static position, to an extent, from the flow of induction air 450 and to flexibly close to the static position, after engine shut down.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A cartridge for installation into an element of an air intake system of an internal combustion engine to adsorb hydrocarbons migrating out of the air intake system during engine shutdown periods, the cartridge comprising:

a) a housing having an opening there through for passage of engine intake air axially of said housing; and b) hydrocarbon-adsorptive material disposed in sheet form within said housing and across said opening, wherein said hydrocarbon-adsorptive sheet material includes a carbon-loaded paper formed from a carbon-containing slurry.

2. A cartridge in accordance with claim 1 wherein said hydrocarbon-adsorptive material includes activated carbon.

3. A cartridge in accordance with claim 1 wherein said hydrocarbon-adsorptive sheet material comprises a spiral-wound strip.

4. A cartridge in accordance with claim 3 further including at least one retainer to maintain spacing between convolutions of said spiral-wound strips.

5. A cartridge in accordance with claim 1 wherein said hydrocarbon-adsorptive sheet material comprises a plurality of corrugated strips having corrugations oriented axially of said housing.

6. A cartridge in accordance with claim 5 further including at least one spacer to maintain spacing between said corrugated strips.

7. A cartridge in accordance with claim 1 wherein said cartridge further includes a plurality of slats extending across said opening and wherein said hydrocarbon-adsorptive material is attached to said plurality of slats.

8. A cartridge in accordance with claim 1 wherein a shape of said housing is selected from the group consisting of cylindrical and rectangular.

9. A cartridge in accordance with claim 1 wherein said housing is close-fitting in an air inlet opening of said element.

10. A cartridge in accordance with claim 7 wherein a shape of at least one of said plurality of slats is selected from a group consisting of V-shaped, bull-nosed shaped and curved shaped.

11. A cartridge in accordance with claim 7 wherein a length of at least one of said plurality of slats is greater than a length of at least another of said plurality of slats.

12. A cartridge in accordance with claim 1 including a sheet material comprising a support having at least one layer of hydrocarbon-adsorptive material applied thereto, wherein said opening includes at least one flap formed in said sheet material.

13. A cartridge in accordance claim 12 wherein said housing is defined by a border region of said sheet material surrounding said at least one flap.

14. A cartridge in accordance with claim 12 wherein said opening comprises a plurality of said flaps.

15. A cartridge in accordance with claim 12 wherein said flap is attached to said sheet material at a fold therein, and wherein said flap is arranged at an angle to said sheet material.

16. A cartridge in accordance with claim 15 wherein said angle is between about 0 degrees and about 90 degrees.

17. A cartridge in accordance with claim 12 wherein said support is formed from heat-settable polymer.

18. A cartridge in accordance with claim 12 wherein said sheet material comprises a support having first and second layers of hydrocarbon-adsorptive material applied thereto on opposite sides thereof.

19. A cartridge in accordance with claim 15 wherein at least a portion of one of said flap and said fold is flexible.

20. An air intake system for an internal combustion engine, comprising a cartridge to adsorb hydrocarbons migrating out of the air intake system during engine shutdown periods, said cartridge including a housing having an opening therethrough for passage of engine intake air axially of said housing, and hydrocarbon-adsorptive material disposed in sheet form within said housing and across said opening, wherein said hydrocarbon-adsorptive sheet material includes a carbon-loaded paper formed from a carbon-containing slurry.

21. An internal combustion engine including an air intake system comprising a cartridge to adsorb hydrocarbons migrating out of the air intake system during engine shutdown periods, said cartridge including a housing having an opening therethrough for passage of engine intake air axially of said housing, and hydrocarbon-adsorptive material disposed in sheet form within said housing and across said opening, wherein said hydrocarbon-adsorptive sheet material includes a carbon-loaded paper formed from a carbon-containing slurry.

22. A cartridge for installation into an element of an air intake system of an internal combustion engine to adsorb hydrocarbons migrating out of the air intake system during engine shutdown periods, the cartridge comprising:

a) a housing having an opening therethrough for passage of engine intake air axially of said housing;

b) hydrocarbon-adsorptive material disposed in sheet form within said housing and across said opening; and c) a plurality of slats extending across said opening, wherein said hydrocarbon-adsorptive material is attached to said plurality of slats, and wherein a shape of an edge of at least one of said plurality of slats is selected from a group consisting of V-shaped, bull-nosed shaped and curved shaped.

23. A cartridge for installation into an element of an air intake system of an internal combustion engine to adsorb hydrocarbons migrating out of the air intake system during engine shutdown periods, the cartridge comprising:

a) a housing having an opening therethrough for passage of engine intake air axially of said housing;

b) hydrocarbon-adsorptive material disposed in sheet form within said housing and across said opening; and c) a plurality of slats extending across said opening, wherein said hydrocarbon-adsorptive material is attached to said plurality of slats, and wherein a length of at least one of said plurality of slats is greater than a length of at least another of said plurality of slats.

24. A method of providing a cartridge for installation into an element of an air intake system of an internal combustion engine to adsorb hydrocarbons migrating out of the air intake system during engine shutdown periods, the method comprising:

providing a papermaking slurry;

adding activated carbon to a papermaking slurry to form a mixture;

forming a hydrocarbon-adsorptive paper material in sheet form from said mixture;

providing a housing having an opening therethrough for passage of engine intake air axially of said housing;

disposing said hydrocarbon-adsorptive sheet material within said housing and across said opening.

25. A method in accordance with claim 24 wherein said hydrocarbon-adsorptive sheet material contains up to 50% by weight of activated carbon.

* * * * *